United States Patent [19]

Barrett

[11] Patent Number: 4,750,570

[45] Date of Patent: Jun. 14, 1988

[54] FORMATION SAMPLING BULLET AND CABLES THEREFOR

[75] Inventor: Bracell P. Barrett, Houston, Tex.

[73] Assignee: Barrett Machine Works, Houston, Tex.

[21] Appl. No.: 922,010

[22] Filed: Oct. 22, 1986

[51] Int. Cl.[4] ..... E21B 49/04

[52] U.S. Cl. ..... 175/4; 175/44

[58] Field of Search ..... 175/4, 58, 20, 44

[56] References Cited

U.S. PATENT DOCUMENTS

| | | | |
|---|---|---|---|
| 2,283,650 | 5/1942 | Sanborn | 175/20 |
| 2,775,427 | 12/1956 | Leone | 175/4 X |
| 2,810,548 | 10/1957 | Martinez | 175/4 |
| 2,873,949 | 2/1959 | Natland | 175/4 |
| 3,072,202 | 1/1963 | Brieger | 175/4 |
| 3,477,525 | 11/1969 | Farrell et al. | 175/4 |
| 4,156,469 | 5/1979 | Laskey | 175/58 |
| 4,280,568 | 7/1981 | McPhee et al. | 175/4 |
| 4,569,403 | 2/1986 | Barrett | 175/4 |

FOREIGN PATENT DOCUMENTS

| | | | |
|---|---|---|---|
| 268170 | 5/1968 | Fed. Rep. of Germany | 175/4 |

*Primary Examiner*—James A. Leppink
*Assistant Examiner*—Hoang C. Dang
*Attorney, Agent, or Firm*—Gunn Lee & Jackson

[57] ABSTRACT

Sampling bullets of the type which are fired into rock formation surrounding a wellbore. The core sampling bullet includes an internal core barrel which is defined in part by a core receiving sleeve releasably secured within the bullet structure. Following bullet retrieval, the bullet is disassembled thereby permitting rearward removal of the core sleeve with core entrapped therein. Following extraction from the bullet, the core sleeve protects the core during handling and testing. The removed core sleeve is further closed by end cap members to further secure the core against contamination and against further loss of gas in core sample prior to testing. The bullet construction also provides for efficiency of hydraulic venting during firing and provides efficiently for bullet with core removal by means of one or more cables. Core orientation is also achieved.

16 Claims, 3 Drawing Sheets

FIG. 1
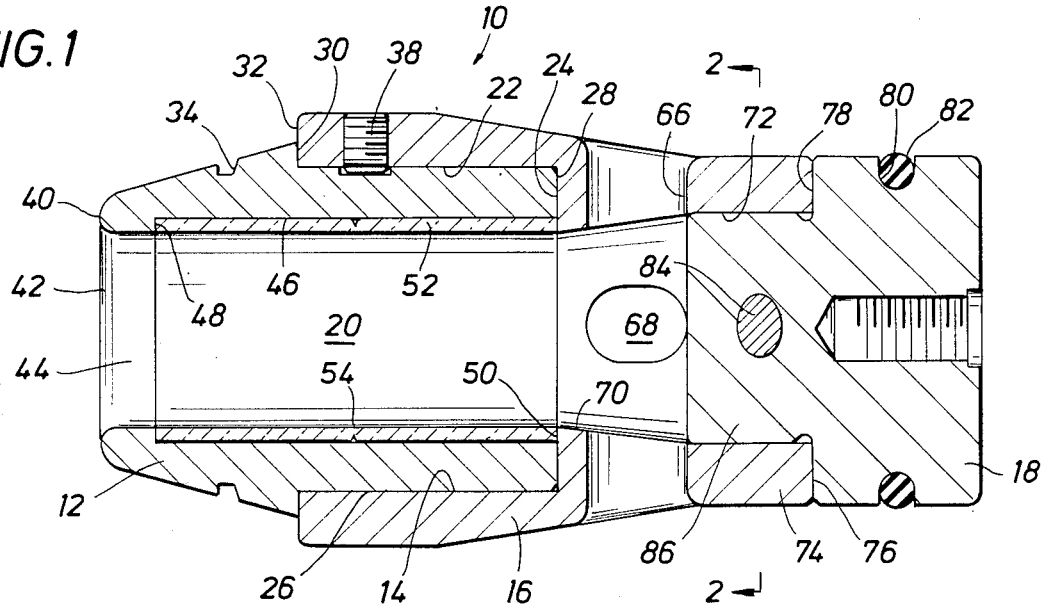
FIG. 2
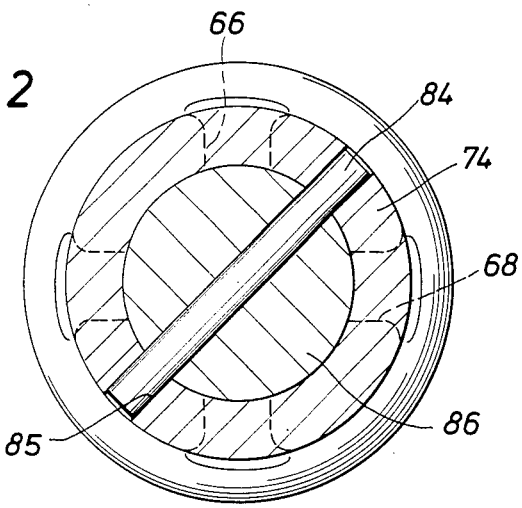
FIG. 3
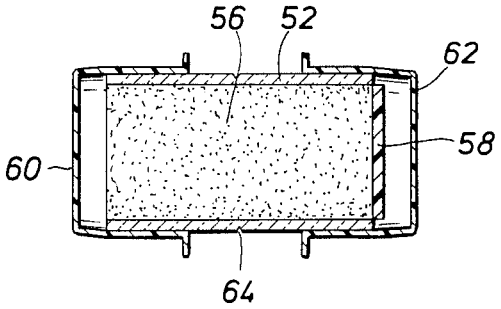
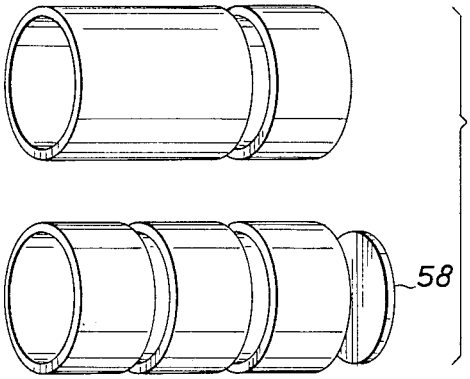
FIG. 4
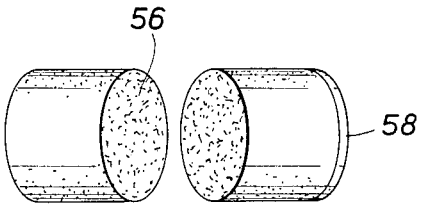
FIG. 5

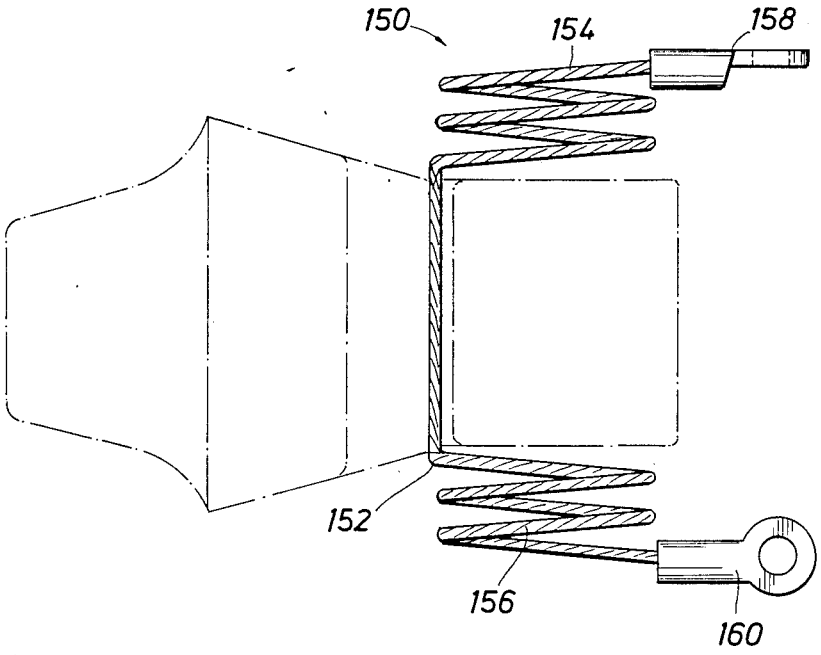
FIG. 8
FIG. 9
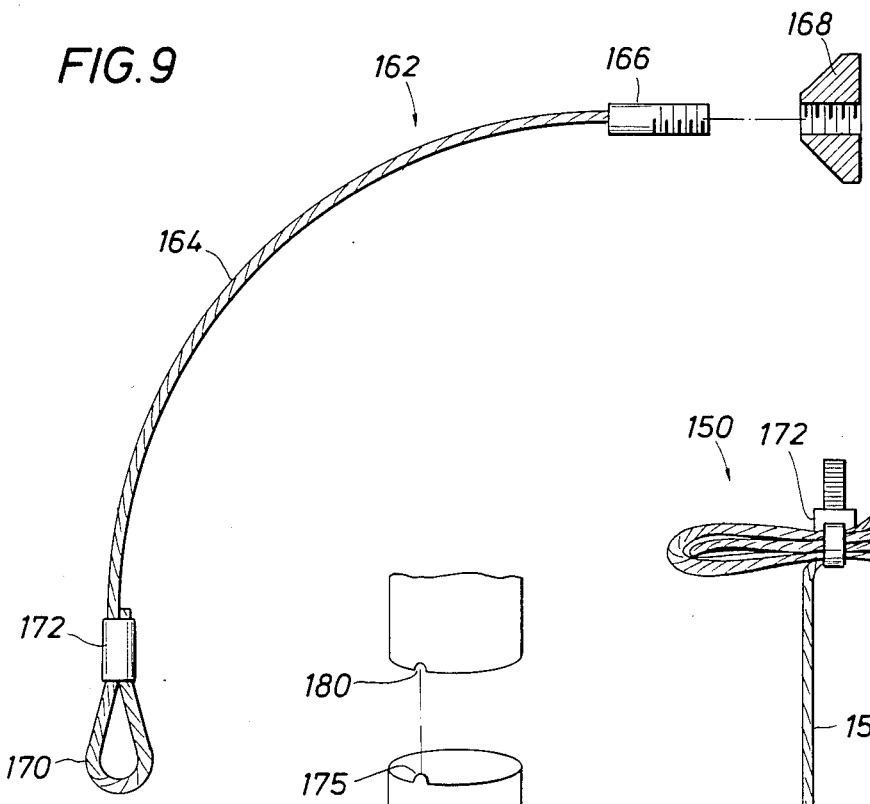
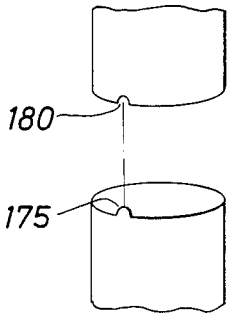
FIG. 11
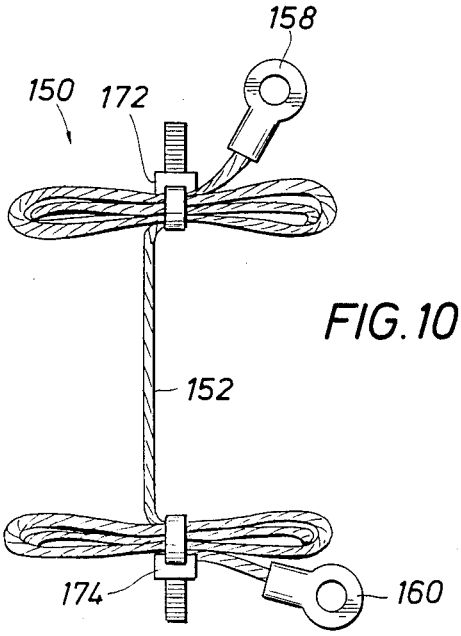
FIG. 10

FORMATION SAMPLING BULLET AND CABLES THEREFOR

RELATED INVENTIONS

The present invention is related to the subject matter of U.S. Pat. No. 4,569,403 issued on Feb. 11, 1986 and entitled "Formation Sampling Bullet" and application Ser. No. 645,696 filed Aug. 30, 1984 now the U.S. Pat. No. 4,702,327 and entitled "Improved Core Sample Taking Bullet Construction".

BACKGROUND OF THE INVENTION

1. Field of Invention

The present invention relates to bullets for obtaining cores or samples from formations adjacent to well bores.

2. Description of Prior Art

In petroleum exploration, it is desirable to determine the nature and composition of rock formations at various depths in a well bore hole. One way has been the use of sampling bullets. Typically, a number of such bullets are mounted with associated explosive charges on a sampling tool for movement through the well bore.

At a selected depth, the charge for one or more of the detonating charges for the bullets is ignited, firing the bullet into the rock formation. The bullet is provided with a central opening or passage which gathers and retains a core or sample of the formation rock as the bullet enters. The bullet enters the rock a distance of about one inch but is kept connected to the tool by wire cable(s). When the tool is moved away from the formation, the bullet is extracted from the formation and is suspended by retrieval cable(s) attached to the tool. After all bullets have been fired, the cores in them are transported by the tool to the surface for geological analysis.

After the sampling tool with its fired, suspended bullets is transported to the surface, the formation cores are removed from the bullets and transported to a suitable facility for geological examination. The bullets may be reused a number of times simply by inserting new firing charges into the sampling tool and properly positioning the bullets within the tool in readiness for subsequent firing.

After the formation cores have been separated from the bullets, they are of course subject to considerable degradation and contamination by the harsh environment of the field. It is desirable, therefore, to provide the formation cores with adequate protection from contamination and degradation.

In many cases, the formation being sampled is relatively unconsolidated and the formation cores tend to fragment upon separation thereof from the core sampling bullets. It is also desirable to maintain unconsolidated core samples intact while removing the samples from the sampling bullets and during transportation of the core samples to a suitable laboratory facility.

It is also desirable to insure that geologists are made aware of the particular orientation of the formation core samples so that the physical character of the formation being sampled may be more readily apparent.

SUMMARY OF INVENTION

Briefly, the present invention provides new and improved formation sampling bullets which are adapted to be fired by explosive charges from a sampling tool into an earth formation adjacent a well borehole to obtain formation samples or cores. According to a principle feature of this invention the bullet may define an internal core receiving passage or receptacle which is lined by means of a removable core retaining sleeve. As the bullet is fired into the wall structure of the well bore, the sleeve, defining a portion of the core receiving passage or receptacle will receive a major portion of the core. The sleeve with its formation core therein is removed from the bullet whereupon the sleeve serves as a protective liner for the core. If the core is from an unconsolidated formation the core sleeve will retain it intact. Sleeve closures or caps are then applied to end portions of the sleeve thereby completing protective enclosure of the sleeve and core and providing efficient protection for the core during further handling. A circular marking groove or other indicia facilitates accurate cross cutting of the core by laboratory technicians to thus provide an undisturbed cross section of the formation from which the core was taken.

The core sleeve may be a single, integral sleeve structure adapted to be contained within a sleeve receptacle defined by the bullet or, in the alternative, the core sleeve may be in the form of two, three or more sections which are likewise retained within the core sleeve receptacle of the bullet. This enables the core to be easily cut or broken into appropriate sections for efficient tests by geological laboratory technicians.

The core sleeve may be composed of transparent material to enable visual inspection of the core while it is contained within the sleeve. Alternatively, the core sleeve may be composed of one or more of various suitable metal or non-metal sleeve materials such as stainless steel, for example.

The present invention is also directed to the provision of a core sampling bullet which may be of integral form or of separable nature as desired and which, in a preferred embodiment, is provided with a cable receiving passage of elongated cross-sectional configuration and is also provided with passages permitting efficient well fluid displacement or venting as the coring bullet is fired into the formation. A preferred form of passage is an elongate hole to the interior. An elongated, U-shaped cable is provided for bullet retrieval from the formation. Prior to firing, the cable is secured in multifolded or looped condition by frangible devices that are broken during the bullet firing activity. The cable is extended loosely through the elongated cable and vent opening of the bullet and provides equalized force to each side of the bullet thereby insuring efficiency and accuracy of bullet extraction from the formation as extraction force is applied to the end portions of the cable by upward movement of the core sampling tool. The cable is arranged to enable one or two bights of the cable to extend between the bullet and support tool.

In another form of the invention the core retrieval cable may have a spring like characteristic enabling it to form coils on each side of the bullet with a central portion thereof being threaded loosely through the cable passage of the bullet. End portions of the cable are connected to the formation sampling tool. Upon firing of the bullet, the coiled cable portions are extended thus allowing the bullet to penetrate the formation to its maximum extent. The bullet is then retrieved from the formation by upward movement of the bore sampling tool. During such upward movement, the cable is moved by the tool to a position of force equilibrium such that substantially equal forces are applied to each side of the core sampling bullet thus enabling it to be moved accurately from the formation with its core retained therein. In this case, the core sampling bullets will again hang suspended by the retrieval cable from the core sampling tool during upward movement of the tool to the surface. Since the force of bullet extraction is equalized by the cable, there is little likelihood that the cable will break as the result of extraction force.

In another form of the invention the bullet retrieval cable system may incorporate separate retrieval cables which are connected by threaded connector studs to threaded openings in the bullet structure. In this case, end portions of the cable are looped and secured by ferrules to insure against cable breakage as the result of extraction force.

An added feature is incorporation of means and a related method of creating a reference mark on a core sleeve to determine the angular position of the core sleeve and sample therein.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is an elevational view, taken in cross-section, of a core sampling bullet and core sleeve assembly constructed according to the present invention;

FIG. 2 is a transverse sectional view, taken along line 2—2 of FIG. 1 and illustrating internal vent and cable passages in broken line;

FIG. 3 is a sectional view of the core sleeve of FIG. 1 containing a core and being closed bymeans of a protective plate and protective end caps;

FIG. 4 is an isometric illustration of core sleeves comprising two or three core sections and representing alternative embodiments of the invention;

FIG. 5 is an isometric illustration of a core such as would be developed by cutting the core sleeve of FIG. 3 across its intermediate marking groove;

FIG. 8 is a view illustrating a core sampling bullet in broken line and showing a bullet retrieval cable constructed in accordance with the present invention; and FIG. 9 illustrates a bullet retrieval cable representing an alternative embodiment of this invention;

FIG. 10 is a view showing a bullet retrieval cable being secured by frangible devices and representing another embodiment of this invention; and FIG. 11 is a view of a core sleeve alignment notch opposite a registration tab.

DESCRIPTION OF THE PREFERRED EMBODIMENT

Figure 6:
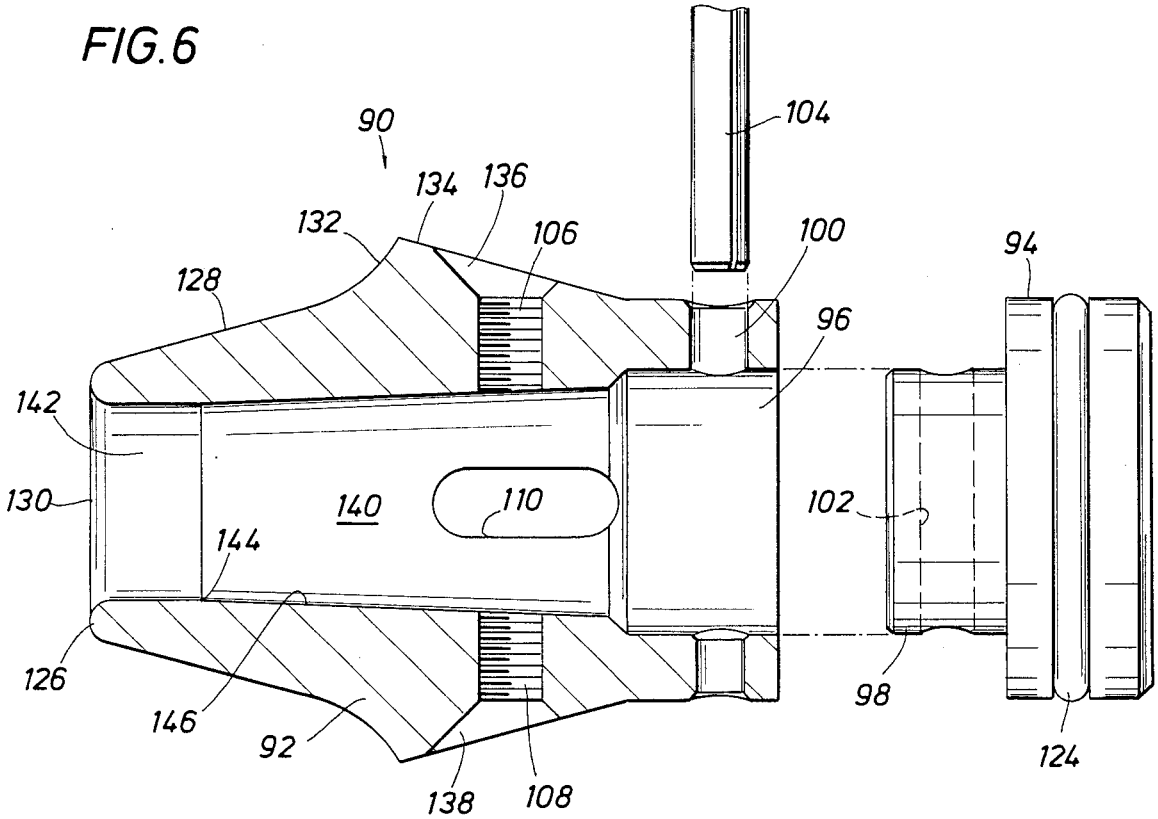
FIG. 6 is an an exploded view, with parts thereof shown in section, representing an alternative embodiment of this invention defining an internal core receiving passage of tapered form and closed at one end by a removable tail plug.

Referring now to the drawings and first to FIG. 1 a formation sampling bullet constructed in accordance with the present invention is illustrated generally at 10 and includes an initial nose contact portion or shuttle 12 which is received and retained within a shuttle receptacle 14 formed within a bullet body structure 16. The shuttle 12 is received in the separable body 16. The basic structure of the bullet is completed by a rear closure member or tail plug 18. The bullet 10 is adapted to be connected by wire cables to, and fired from, a conventional core sampling tool, not shown, which is moved by a wireline or other mechanism to various depths within in a well bore. When located at a selected depth adjacent to a formation of interest, an explosive charge in the sampling tool is detonated, as is conventional, and the bullet 10 is fired into the surrounding rock formation. A core sample of the formation rock is forced into a central opening or core barrel 20 of the bullet as the formation rock is entered by the bullet. Typically, a penetration of one inch or slightly more into hard rock formation by the bullet occurs for a conventional explosive charge. Where less consolidated formation is encountered, the depth of bullet penetration and thus the resulting dimension of the core will differe substantially.

After a number of the bullets have been fired at selected locations in the well bore, the sampling tool is then withdrawn from the borehole. As this occurs, the bullets 10 are extracted from the formation by means of their wire cable connections and the core captured by and remaining in the bullet is transported to the surface by the sampling tool connection. Ordinarily, the core is then forced from the bullet 10 by a rod or plunger under suitable force, so that analysis can be performed on the sample to investigate geological conditions of interest.

As explained above, considerable core deterioration or contamination may occur after the core is separated from the bullet, thus requiring laboratory personnel to trim away contaminated portions of the core prior to geological analysis. According to the present invention, the core taken by the sampling bullet may be efficiently protected from contamination or deterioration during and after separation from the bullet. This feature will become more evident as the core sampling bullet is explained in further detail.

The shuttle receptacle 14 of the bullet body 16 is defined by an inner general cylindrical surface 22 which intersects a radial surface 24 forming a thrust shoulder within the rear portion of the shuttle receptacle. The initial nose contact or shuttle portion 12 of the bullet forms a corresponding generally cylindrical surface 26 which is received in close fitting, releasable relation within the cylindrical surface 22 of the shuttle receptacle. The shuttle defines a rear thrust shoulder 28 which is disposed for thrust transmitting engagement with thrust shoulder 24. The forward portion of the shuttle 12 also defines a thrust shoulder 30 which is positioned for engagement with an annular shoulder surface 32 defining the forwarded extremity of the bullet body 16. A circular snap ring groove 34 is formed by the shuttle structure and in inclined rearwardly. A suitable snap ring may be received by the snap ring groove to provide for retention of a circular sacrificial element left in the formation after entry and retrieval.

The shuttle 12 defines a circular nose portion 40 of rounded configuration which defines an entry opening into the core barrel 20 of the shuttle. Immediately inwardly of the entry opening 42 is an entry section 44 of the core barrel. Inwardly of the entry section 44, the shuttle 12 defines an enlarged diameter generally cylindrical surface 46 which intersects a radial shoulder surface 48 forming a sleeve retention surface. Surfaces 46 and 48 cooperate to define an elongated, generally cylindrical core sleeve receptacle. The radial thrust surface 24 extends radially beyond the cylindrical surface 46 and forms a circular abutment shoulder 50 which also serves as a sleeve retention surface. Abutment shoulders 48 and 50 provide supporting engagement with opposite extremities of a generally cylindrical core sleeve 52. The core sleeve 52 is entrapped in immovable relation within the core sleeve receptacle and forms an inner cylindrical surface 54 which defines a portion of the core barrel 20 of the bullet. The circular entry surface 44 of the bullet is of slightly smaller dimension compared to the dimension of the cylindrical internal surface 54 of the core sleeve 52. For example, in a particular bullet construction, entry surface 44 may have an internal diameter in the order of 0.010 smaller than the internal diameter of the core sleeve 52. The radius on the cutting edge of the bullet shuttle controls the compression of the sample core. Since the internal diameter of the entry portion 44 of the core barrel is slightly smaller than the internal diameter of the core sleeve, pressure is avoided on the core sleeve as the formation core enters the sleeve. This also allows the formation core to swell slightly to normal porosity or permeability after it has entered the core sleeve. The formation core in the entry portion is bound by compression to lock the sample core in place. This is easily dislodged to allow removal with the core sleeve from the shuttle. The compressed portion, or button, is then visible at the top of the core sleeve.

The core sleeve is formed of any of a number of suitable sleeve materials. For example, it may be composed of transparent material enabling personnel to visually inspect the core while at the same time permitting the core to remain free of contamination. The core sleeve may also be composed of any of one of a number of suitable metals including stainless steel for efficient protection of the core during handling and for storage if desired.

As shown in FIG. 3 a core sleeve 52 is shown with a formation core 56 secured therein. One or both ends of the core 56 may be protected by means of a closure plate or cap as shown at 58. The cap 58 may be composed of plastic material as shown or by any one of the number of suitable materials capable of adequately protecting the core 56. The core may be further protected by means of closure caps 60 and 62 composed of plastic or any other suitable material. The closure caps 60 and 62 are sized to establish friction tight assembly about the outer cylindrical end portions of the core sleeve. In the event that gas is trapped in the pore of the sample, the sealing and closure technique of this disclosure assures that the gas is captured for later analysis. For instance, gas can be pulled from the sample in small quantity and analyzed by a suitable laboratory analytical device.

After the bullet 10 has been transported to the surface the set screw 38 is moved to its release position. Thereafter the shuttle portion 12 of the bullet is simply extracted from the shuttle receptacle 14 thereby exposing the rear portion of the core sleeve and core. If desired at this time, a closure plate such as that shown at 58 in FIG. 3 may be positioned in protective assembly with the front end portion of the core. The core sleeve and core are then simply moved rearwardly for extraction from the core sleeve receptacle leaving the core and core sleeve in the condition illustrated in FIG. 3. The closure caps 60 and 62 are then applied and the core sample is transported in a protected manner to an appropriate laboratory for analysis. The core sleeve may be formed to define an exterior circular groove such as shown at 64 enabling a geologist or lab analyst to make an accurate transverse cut across the core to thus insure that the exposed ends of the core accurately represent the orientation and configuration of the formation strata. A core section in this manner will be in the form illustrated in FIG. 5.

Although a single integral core sleeve may be employed such as shown in FIGS. 1 and 3, such is not intended to limit the present invention. The core sleeve may be defined by two sections such as shown at the upper portion of FIG. 4 or by three sections as shown by the lower section of FIG. 4. These interfitting sections define accurate guide lines for cutting of the core by geologists or lab analysts for accurate presentation of the formation strata. Regardless of the number of core sleeve sections that are utilized to make up the core sleeve, the sections will be received in tightly secured, immovable relation within the core sleeve receptacle of the bullet. The core sleeve is intended merely to receive the core that is cut by the shuttle portion of the bullet as the bullet is fired into the formation. It provides no cutting or unusual core retention function. The core sleeve is not fired into the formation; rather it simply travels along with the shuttle portion of the bullet and provides a receptacle for the formation core that is cut by the circular nose portion of the bullet. The core sleeve is not deformed as the formation core is encountered. At 48, the core sleeve may be slightly wrinkled or upset, providing further retention capability.

As the bullet is fired into the formation the core barrel 20 of the bullet will be filled with well fluid. To prevent bullet penetration from being retarded by hydraulic compression, the body portion 16 of the bullet defines radiating intersecting vent passages 66 and 68. As the bullet penetrates into the formation, hydraulic fluid is enabled to escape from the core barrel through the radiating vent passages and thus presents no significant retardation to bullet penetration. Each of the passages 66 and 68 intersects a rearwardly flared central opeing which is tapered from the internal dimension of the core sleeve 52 to the internal dimension 72 of the tail portion 74 of the bullet body. So to speak, the surfaces are faired with a smoothly curved juncture with the hole and outer surface intersection. The tail portion 74 defines a circular thrust shoulder 76 which is engaged by a corresponding circular shoulder 78 of the tail plug 18. The tail plug defines an external seal groove 80 receiving a O-ring type sealing member 82 to protect the explosive charge in the sampling tool from contact by well fluid prior to detonation of the explosive charge.

The tail plug 18 is secured in assembly with the tail portion of the bullet body 16 by means of a connection pin member 84 which is received within a passage 85 through the tail portion 74 and the reduced diameter portion 86 of the tail plug. The connection pin 84 has particular alignment for registry with the set screw member 38. Positioning of the pin 84 and the screw 38 enables the user to accurately locate the bullet relative to the core sampling tool so that the geologist will have a reference for indentification of the formation strata in the core sample. With this orientation, the "up" side of the bullet is at 12 o'clock and the other clock references are similar in orientation. To elaborate on this and the value of this information, the following procedure is suggested as a method of orientation. The wireline supported core sampling tool is lowered in a well borehole to a known depth. Such errors arising on wireline elongation can be determined easily. Assume as an example that the wireline is lowered to 8200 feet in a well. Stretching can be determined accurately and is added. Even the length of the core sampling tool from connection of the wireline to the individual core sampling bullet mounted thereon is readily measured. Thus, exemplary corrections of 30 feet and 3 feet might be added to locate a particular bullet 8233 feet downhole. Through the use of known techniques, the bullets are pointed at a selected azimuth such as 90° or due east. While this data is known in particular, the "up" side of the core taken at this location is otherwise unknown. The prsent apparatus and proposed method produce such information.

Attention is momentarily direction to FIG. 11 showing a cooperative tab and notch alignment system. The tab 175 on the bullet bottom is located at a specific place on the exposed face. This serves as an alignment mark for the core sample sleeve. This sleeve has a mating and matching notch 180 to receive the tab 175 and thereby lock the core sleeve against rotation. The bullet is mounted in the core sampling tool and is registered. As observed in FIG. 1, the set screw 38 can be used as a reference marker, i.e. up is defined along the core sampling tool and the screw 38 is positioned at an aligned location.

While the foregoing can be done to obtain accurate positioning before core sampling, there is totally uncertainty after sampling and retrieval of the core for subsequent testing. The arrangement of FIG. 11 provides a means and method of registering the core in the sleeve so that the core angular orientation in the formation can be reconstructed. The tab and notch arrangement preserves a reference mark when the core and sleeve (e.g., see FIG. 3) are removed and shipped to a laboratory for analysis. In sum, the last step of core handling is accomplished with the assurance of core orientation from use of this invention. As will be understood, the shape of the tab and notch can be varied so long as a user can recognize the mark on the sleeve and is assured of mark registration in use.

Passage 66, in addition to serving as a fluid venting passage for the core barrel, also serves to receive a bullet retrieval cable which may be of the character illustrated in FIGS. 7, 8, 9 and 10. The passage 66 has an elongated cross section with rounded extremities such as shown at 110 in FIGS. 6 and 7. Because the depth of penetration through the mud pack and into the formation carries the present side mounted retrieval cables deep into the core sample hole, it is often difficult to retrieve the bullet. Also, stress is rarely equal on each cable, causing first one and then the second cable to break as retrieval is attempted. By contrast with present formation coring bullets where the cable construction actually weakens them (the soldered joint reduces the strain capacity), the present bullet can accommodate force resisting bullet retrieval.

The elongated vent and cable passage 66 allows simple insertion of a single cable, enabling it to pass loosely through the bullet. The cable is provided with a loop at each end, each loop fastened with a sleeve or ferrule. These loops are fastened in the core gun with existing hardware. After the bullet is fired and the core gun is pulled from the surface for retrieval of the bullet from the formation, the single cable slides to equalize for the required pulled applied to the bullet. This distributes the bullet retrieval load across the back of the bullet body at an improved angle, resulting in a stronger, more reliable retrieval system. Moreover, the retrieval cable resists significantly great retrieval loads because it slides through the passage 66, thus allowing the retrieval force to be evenly distributed to each side of the cable. The elongated vent and cable opening 66 is radiused and chamfered at its intersection with the outer surface of the bullet structure to allow non-abrasive movement of the single cable during retrieval. The cable is not exposed to sharp bends or corners and its load capacity remains maximum. By employing the elongated vent opening 66 for the single cable, bullet retrieval is safely done.

Figure 7:
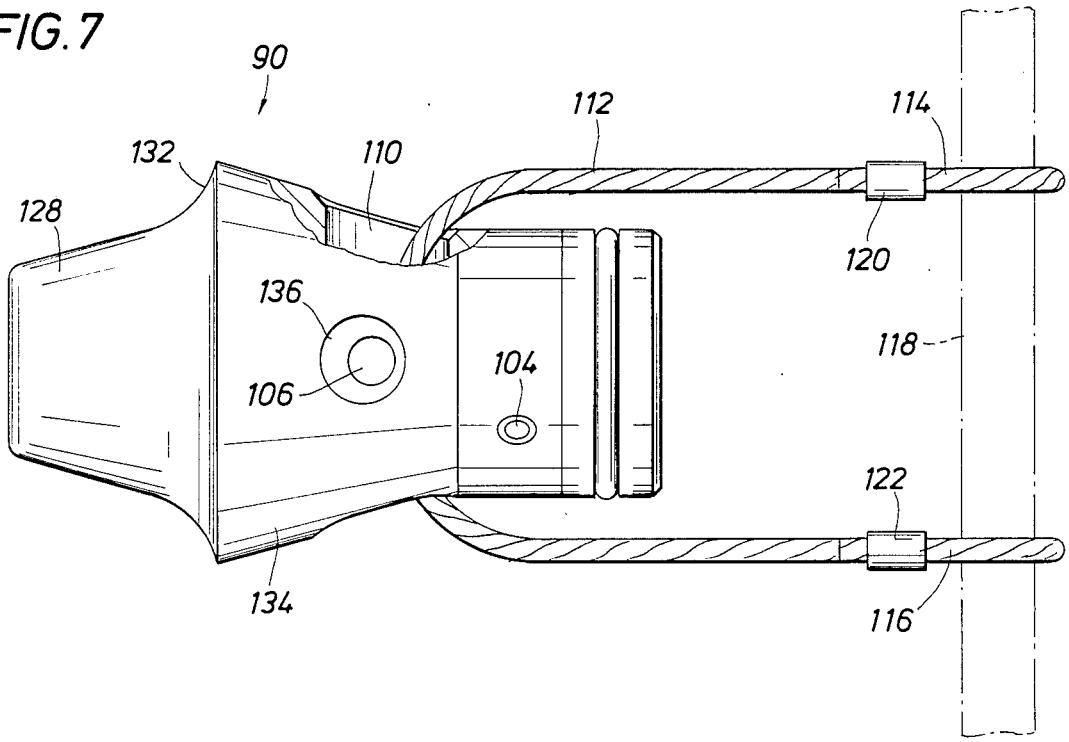
FIG. 7 is an elevational view of the core sampling bullet construction of FIG. 6.

Referring now to FIGS. 6 and 7, an alternative embodiment of this invention is illustrated generally at 90 which is generally in the form of a sampling bullet unit including a body structure 92, the rear portion of which is closed by means of a tail plug 94. The body 92 forms an internal cylindrical passage section 96 which receives a reduced diameter portion 98 of the tail plug 94. The body further defines a transverse passage 100 which is disposed in registry with a corresponding transverse passage 102 formed in the tail plug. A retainer pin 104 is extended through the passages 100 and 102 and functions to retain the tail plug in secure assembly with the body 92. The passage 100 is the entry passage and is therefore larger in diameter. This is conveniently implemented by using a hole which is about 0.01 inches larger. At the opposite side the passage 100 is smaller to snuggly hold the pin 104.

For retrieval of the bullet after firing, the body 92 is secured to a suitable support body by means of one or more bullet retrieval cables. The body 92 forms internally threaded openings 106 and 108 which are adapted to receive externally threaded cable connectors with the cables thereof being appropriately secured to the sampling tool. The body 92 also forms a cable passage 110 of elongated cross sectional configuration as shown in FIG. 7, is adapted to receive a single bullet retrieval cable 112 which passes loosely through the passage 110 with the respective end portions 114 and 116 thereof suitably connected to a support body 118 of the sampling tool. To insure that the cable 112 maintains maximum force resisting capability, the end connections 114 and 116 thereof are formed by simple cable loops which are secured by means of ferrules 120 and 122.

The tail plug 94 forms a seal groove receiving an O-ring sealing member 124 which maintains a seal with the sampling tool to isolate the explosive charge from well fluids prior to detonation thereof.

The bullet body 92 defines a rounded contact nose 126 and is adapted for use in very hard rock formations. Better penetration with less damage of rock formations have been found to occur than with the knife or pointed - edge bullets of the prior art. A radially outwardly tapering surface 128, typically on the order of 15° with respect to the longitudinal axis of the bullet 90 extends from the circular rounded nose 126. The surface 128 compresses and opens the formation rock as the bullet enters into the rock so that the core sample entering the opening 130 formed by the rounded nose 126 is separated from the formation. An outward ramp surface 132 is formed extending outwardly from the tapered surface 128. The ramp surface 132 functions as a stopping brake for the bullet 90 during later stages of entry into the formation. Additionally, the ramp surface 132 provides additional bullet mass to increase penetration of the rounded nose 126 into the formation. Finally, the ramp 132 shields the retrieval cable and cable studs connected at the threaded openings 106 and 108. An inwardly tapering outer surface portion 134 extends rearwardly from ramp surface 132 at an angle of about 15° from the longitudinal axis of the bullet. Conical surfaces 136 and 138 are also formed by the body 92 to define access openings to the internally threaded openings 106 and 108. This permits cable studs to be recessed within the body and thus provides additional protection for the cable studs and cable.

An elongated core barrel 140 having a forward generally cylindrical section 142 merges at a transition point 144 with an elongated internal tapered surface 146. The cylindrical surface portion 142 serves as a binding surface, locking the core sample from falling downwardly through the bullet into the well bore as the sampling tool is being drawn upwardly through the well bore to the surface. Further, the tapered surface 146, even with a degree of taper of only 1 to 5 degrees or so, forms a pocket to hold loose small pieces of core sample much in the manner of a funnel. The tapered surface 146 allows the core sample to go deeper into the core barrel 140 for the same amount of explosive power. Additionally, the core sample moves easily into the core barrel after initial rock penetration. Finally, when the bullet is received at the surface, the outwardly tapering surface allows the core sample to be more easily forced from the core barrel with less damage to the core sample than with continuously cylindrical core barrels.

In FIG. 8, a bullet retrieval cable 150 is shown loosely extended through a cable receiving passage of a core sampling bullet in broken line. The cable receiving passage has the form shown at 110 in FIGS. 6 and 7. The cable structure 150 includes a single length of cable 152 with its central portion passing through the cable opening of the bullet. End portions 154 and 156 of the cable are coiled prior to firing of the bullet to secure the cable out of the way so that it does not interfere with positioning of the sampling tool prior to firing of the bullet. The calbe has a spring-like character enabling the coils to remain securely positioned prior to firing the bullet. End portions of the cable are defined by ferruled connectors 158 and 160, adapting the cable to be secured to the sampling tool by bolts or by any other suitable means.

Referring now to FIG. 9, the bullet retrieval cable may take an alternative form illustrated generally at 162. The cable includes a length of cable 164 having an externally threaded cable stud 166. The cable stub 166 is capable of being received by a connector member 168 as shown in FIG. 9. The opposite extremity of the cable length 164 is looped to form a connector loop 170 clamped by a ferrule 172. The loop 170 is connected to the core sample tool while the connector 168 prevents cable slippage through the bullet. As shown in FIG. 10 the bullet retrieval cable 150 may be folded about itself several times and secured by means of plastic ties 172 and 174 enabling it to be maintained out of the way until the bullet is fired. As firing occurs, the plastic ties 172 and 174 will break thus freeing the cable for extension during diring and for the subsequent bullet retrieval operation.

The foregoing disclosure and description of the invention are illustrative and explanatory thereof, and various changes in the size, shape and materials as well as in the details of the illustrated construction may be made without departing from the spirit and scope of this invention.

What is claimed is:

1. In a formation sampling bullet adapted to be fired at high speed by an explosive charge from a support apparatus into an earth formation adjacent to a well borehole to penetrate the formation with a nose portion of the bullet to obtain and hold a formation core sample in a longitudinal bore extending rearwardly from said nose member portion of said bullet, the bullet comprising:

(a) an initial contact nose portion at a forward end of an elongated core barrel, said nose portion terminating at a circular opening of specified diameter at said nose portion, said nose portion including an exposed cutting means around said opening to cut a sample core entering into an axial passage along said elongated core barrel;

(b) a core receiving sleeve having forward and rear ends immovably and releasably located in said axial passage within said bullet, said core sleeve being removable from said bullet following retrieval of said bullet;

(c) first shoulder means in said axial passage for locking said sleeve forward end;

(d) second shoulder means in said axial passage for locking said sleeve rear end;

(e) said passage having a rearward extent longer than said sleeve to form an area to receive material other than a formation core sample, said passage extending along said core barrel;

(f) vent passage means extending away from the rearward extent of said passage to enable venting of materials upon entry of a formation core sample into said sleeve; and (g) means enabling said sleeve to be released from said core barrel with a core sample therein, and also enabling subsequent reinstallation of said sleeve in said core barrel in locked relationship to said first and second shoulder means.

2. The apparatus of claim 1 wherein said vent passage means has an oval cross section, and further including a bullet retrieval cable loosely through said oval passage means, said cable having end means adapted to be secured to the support apparatus.

3. The apparatus of claim 2 including a tail plug closing said passage rearward extent, said tail plug having seal means for sealed assembly of said bullet to the support apparatus.

4. The apparatus as recited in claim 3 wherein:

(a) said core barrel has a fastener receiving passage;

(b) said tail plug has a registered fastener receiving passage; and (c) a fastener extending through said core barrel passage and said registered tail plug passage for securing said tail plug in positive assembly with said core barrel.

5. The apparatus of claim 4 wherein said core barrel is formed of two separate components, said components being:

(a) a separable contact nose portion having said first shoulder means therein;

(b) a separable core barrel portion having said second shoulder means therein; and (c) lock means cooperating with said separable contact nose portion and said separable core barrel portion for securing said portions in releasable assembly, said lock means being positioned in registered relation with said fastener to enable alignment of the formation sampling bullet relative to the support apparatus for orientation of a sample core within said sleeve.

6. The apparatus of claim 5 including removable cap means for enclosing ends of said sleeve and thus further protecting a formation core sample contained within said sleeve, said cap means having an internal dimension for friction fit assembly about respective ends of said sleeve.

7. The apparatus of claim 6 wherein said sleeve has external cutting guide means permitting accurate cross-sectional cutting of said sleeve and sample core therein.

8. The apparatus of claim 7 wherein said cutting guide means includes a circular groove formed in the exterior of said sleeve.

9. The apparatus of claim 7 wherein said sleeve is a serial plurality of core sleeve segments in end-to-end relation to define said sleeve, said plurality of core sleeve sections being retained in immovable abutting relation until cutting.

10. The apparatus of claim 5 wherein said contact nose portion defines an entry opening of specified diameter, and said sleeve has slightly greater internal dimension as compared to the internal dimension of said entry opening.

11. The apparatus of claim 1 including:

(a) said vent passage means has an oval cross section connected from said axial passage; and (b) an elongated bullet retrieval cable loosely through said vent passage means and having end portions thereof adapted for connection to a support apparatus and also having coiled portions of said bullet retrieval cable extendable upon firing of said bullet.

12. The apparatus of claim 1 including:

(a) an elongated bullet retrieval cable loosely connected with said bullet and having end means thereof adapted for connection to the support apparatus, said cable being extendable upon firing of said bullet; and (b) sacrificial cable tie members securing said cable in loops, said tie members upon firing of said bullet breaking and releasing said retrieval cable for extension thereof.

13. The apparatus of claim 11 including:

(a) an internally threaded receptacle on said bullet; and (b) said bullet retrieval cable having an externally threaded anchor stud threadedly received by said internally threaded receptacle, said bullet retrieval cable being adapted for connection to the support apparatus.

14. The apparatus of claim 2, including:

(a) a tail plug closing said passage rearward extent said tail plug having seal means for sealed assembly of said bullet to the support apparatus;

(b) said core barrel has a fastener receiving passage;

(c) said tail plug has a registered fastener receiving passage;

(d) a fastener extending through said core barrel passage and said registered tail plug passage for securing said tail plug in positive assembly with said core barrel;

(e) wherein said core barrel is formed of two separate components, said components being:

(1) a separable contact nose portion having said first shoulder means therien;

(2) a separable core barrel portion having said secodn shoulder means therein; and (f) lock means cooperating with said separable contact nose portion and said separable core barrel portion for securing said portions in releasable assembly, said lock means being positioned in registered relation with said fastener to enable alignment of the formation sampling bullet relative to the support apparatus for orientation of a sample core within said sleeve.

15. The apparatus of claim 14 including orienting means establishes a desired position relation of the support apparatus and said contact nose portion, said orienting means being particularly oriented relative to said locking menas to provide for selected orientation of said formation sampling bullet relative to the support apparatus.

16. The apparatus of claim 14, wherein said sleeve is formed of transparent material enabling visual inspection of the core sample while said core sample is protected by said elongated core sleeve.

* * * * *